US005668522A

United States Patent [19]

Kondo et al.

[11] Patent Number: 5,668,522

[45] Date of Patent: Sep. 16, 1997

[54] SLOWLY-BREAKING FUSE AND METHOD OF PRODUCTION

[75] Inventors: Hiroki Kondo; Mitsuhiko Totsuka; Toshiharu Kudo; Hisashi Hanazaki, all of Shizuoka, Japan

[73] Assignee: Yazaki Corporation, Tokyo, Japan

[21] Appl. No.: 330,837

[22] Filed: Oct. 27, 1994

[30] Foreign Application Priority Data

Oct. 28, 1993 [JP] Japan ..... 5-291478

[51] Int. Cl.[6] ..... H01H 85/02; H01H 85/04; H01H 85/52; H01H 85/143

[52] U.S. Cl. ..... 337/198; 337/160; 337/216; 337/260; 337/270

[58] Field of Search ..... 337/152, 160, 337/270, 198, 216, 260

[56] References Cited

U.S. PATENT DOCUMENTS

| | | | |
|---|---|---|---|
| 3,432,923 | 3/1969 | Feenan | 337/290 |
| 4,831,353 | 5/1989 | Gaia et al. | 337/255 |
| 4,944,084 | 7/1990 | Horibe | 29/623 |
| 5,262,751 | 11/1993 | Kudo | 337/160 |
| 5,373,278 | 12/1994 | Saulgeot | 337/255 |

FOREIGN PATENT DOCUMENTS

| | | | |
|---|---|---|---|
| 50-101845 | 8/1975 | Japan | H01H 85/56 |
| 61-271731 | 12/1986 | Japan | H01H 85/56 |

*Primary Examiner*—Leo P. Picard
*Assistant Examiner*—Stephen T. Ryan
*Attorney, Agent, or Firm*—Sughrue, Mion, Zinn, Macpeak and Seas

[57] ABSTRACT

A slowly-breaking fuse includes a housing made of a synthetic resin, a fuse element including a pair of terminal members for an electrical connection, and a melting member mounted between the terminal members, the melting member being smaller in thickness than the terminal member, the melting member having a narrow elongated central portion and a pair of base portions between which the narrow elongated central portion is mounted, and a cross-sectional area increased member provided at an opposite end of the melting member.

5 Claims, 4 Drawing Sheets

SLOWLY-BREAKING FUSE AND METHOD OF PRODUCTION

BACKGROUND OF THE INVENTION

1. Field of the invention

This invention relates to a slowly-breaking fuse suited for protecting an electric motor such as a power window motor of an automobile.

2. Related Art

Generally, the type of fusion of fuses used for protecting an electric circuit in an automobile or the like is classified into the fusion in a high current region and the fusion in a low current region. One example of the former fusion in a high current region is a fusion due to a burst current developing in the event of a dead short-circuit of a circuit, and in this case the time period from heat generation to fusion is relatively short, that is, within several seconds.

On the other hand, in the latter fusion in a low current region, the temperature of the fuse gradually rises as when a low excess current is lasting for a long period of time, and then the fuse is fused. Thus, it takes a relatively long period of time from heat generation to the fusion of the fuse.

For example, when a load circuit of an electric motor or the like is activated, an instantaneous excess current, several times larger than a steady-state load current value, flows through the circuit. When a power window motor is in a motor lock condition upon full opening or closing of a window glass pane, a motor lock current, several times larger than a steady-state load current value, flows through it, and therefore even when any abnormal condition, such as short-circuit of the circuit is not encountered, the current, exceeding the steady-state current value, frequently flows.

Therefore, in a load circuit for an electric motor, a power window motor and so on, there has been used a so-called slowly-breaking fuse of gentle characteristics which will not fuse for such instantaneous excess current and motor lock current exceeding a steady-state current value, but will positively interrupt the excess current in the event of slight short-circuit. In the slowly-breaking fuse, a piece of low-melting metal, having high thermal conductivity and a good heat-absorbing property, is supported on a generally central portion of the fuse of high-melting, fusible metal, and the heat, generated in a melting portion by excess current during use, is transferred to and absorbed by the low-melting metal piece, thereby ensuring a time lag before fusion occurs. Namely, an allowable range of the melting portion is increased by the low-melting metal piece so that even if the excess current flows, the melting portion will not instantaneously be fused, thereby ensuring the retarded fusion.

At this time, if this retarded breakage becomes too excessive, a wire and a housing become heated, in which case a covering of the wire may be burned, or the housing may melt. Therefore, the slowly-breaking fuse must be fused without delay when the predetermined time lag is over.

By the way, recently, a fuse has been required to have a small design and an increased rated current value, and it has become necessary to specify the position of the melting portion so that the housing will not be burned by the heat of the fuse, and also it has become necessary to narrow the space of the heating portion in order to suppress the transfer of the heat to fuse terminals. Therefore, if there is provided a construction by which the position of development of the above hot spot (the melting portion) is fixed, and the hot spot is reduced as much as possible so as to effect the fusion at an extremely narrow region, then the transfer of the heat to the vicinity portions including the wire and the fuse terminals can be reduced, thereby suppressing the overall heating of the fuse, and besides the heating of the fuse is effectively used, thereby achieving the slowly-breaking fuse excellent in fusion sensitivity even in a low current region.

Therefore, in order to specify the position of the melting portion and also to narrow the space of the heating portion, it is necessary to provide such a construction that the current density at the hot spot becomes extremely high as compared with the current density of the vicinity portions, and also it is necessary to provide such a construction that the current density at the hot spot is abruptly increased with respect to the current density of the vicinity portions. Such current density characteristics can be achieved by extremely reducing the cross-sectional area of that portion of the fuse element at which the hot spot develops, with respect to the cross-sectional area of those portions disposed forwardly and rearwardly adjacent to this hot spot portion. The higher the constriction rate of the hot spot is, the more easily the fusion can be effected at the above extremely narrow region.

There have been proposed the following various methods of improving the fusion sensitivity by increasing the constriction rate of the hot spot.

For example, as shown in FIGS. 5 (*a*) and (*b*), a fuse 100 of the plug-in type disclosed in Japanese Patent Unexamined Publication sho. 50-101845 comprises as a constituent part a fuse element 102 inserted into a housing 101, and this fuse element 102 has a pair of blade-like terminals 103 and 103, and a link portion 105 interconnecting these terminals. The link portion 105 is cut into a thin configuration by milling, and after this cutting operation, this link portion is compressed to form a melting portion at a generally central portion thereof.

As shown in FIG. 5(*b*) which is a cross-sectional view, the thickness $t_0$ of the generally central portion of the link portion 105 serving as the melting portion is made smaller than the thickness $t_1$ and $t_2$ of those portions disposed forwardly and rearwardly adjacent to this melting portion, so that the cross-sectional area $S_0$ of the melting portion is smaller than the cross-sectional area $S_1$ and $S_2$ of the forwardly and rearwardly adjacent portions. By doing so, the constriction rate of the hot spot is increased, thereby improving the fusion sensitivity.

In a fuse shown in FIGS. 6 (*a*) and (*b*) which is disclosed in U.S. Pat. No. 4,831,353, a fuse element 120 formed by stamping a metal plate has a link portion 121 on which a plurality of weak spots 122, 123 and 124 are formed.

As shown in FIG. 6(*b*) which is an enlarged view of an important portion, the cross-sectional area $S_0$ of each weak spot is made smaller than the cross-sectional area $S_1$ and $S_2$ of the forwardly and rearwardly adjacent portions, so that the constriction rate of the hot spot is increased, thereby improving the fusion sensitivity.

In a fuse shown in FIG. 7 which is disclosed in Japanese Patent Unexamined Publication sho. 61-271731, a fuse element 131 inserted into a housing 130 has an S-shaped link portion 132 in which a notch 133 defined by a through hole is formed. Thus, the cross-sectional area is minimized at the position where this notch 133 is provided, thereby increasing the constriction rate of the hot spot so as to improve the fusion sensitivity.

However, the above conventional slowly-breaking fuses have problems. More specifically, the fuse disclosed in the above Japanese Patent Unexamined Publication sho. 50-101845, in which the thickness of the link portion is reduced by milling and compressing, suffers from a drawback that the machining costs are extremely increased for achieving a strict tolerance. The fuses disclosed in the above U.S. Pat. No. 4,831,353 and the above Japanese Patent Unexamined Publication sho. 61-271731 have problems that an expensive die is required for forming the link portion of a complicated shape and that it is difficult to increase the yield rate of satisfactory products, and thus the problem with respect to the increased processing cost remains unsolved.

To increase the constriction rate of the hot spot by such machining is limited, and the constriction rate could not be increased any further. Namely, generally, in the stamping by a press, a processing limit is the width about twice larger than the plate thickness, and the fuse having the constricted portion of a smaller width than that value can not be formed by pressing.

SUMMARY OF THE INVENTION

It is therefore an object of this invention to overcome the above problems, and more specifically to provide a good slowly-breaking fuse, as well as a method of producing the same, in which the constriction rate of a melting portion of a fusible member is increased to specify the position of the melting portion and also to narrow the space of a heating portion, and there are achieved highly-sensitive fusion characteristics which enable the fusion with a limited amount of generated heat.

The above object of the invention has been achieved by a slowly-breaking fuse wherein a melting portion of a narrow width, provided at a central portion of a fusible member of electrically-conductive metal, is formed integrally with a pair of terminal portions, wherein a pair of cross-sectional area-increased portions are formed adjacent to opposite ends of the melting portion, respectively, wherein the cross-sectional area-increased portions are formed by once melting a low-melting member lower in melting point than the electrically-conductive metal, and then by solidifying the molten member.

The above object of the invention has also been achieved by a method of producing a slowly-breaking fuse wherein a melting portion of a narrow width, provided at a central portion of a fusible member of electrically-conductive metal, is formed integrally with a pair of terminal portions; comprising the steps of the steps of integrally forming a pair of retaining means adjacent to opposite ends of the melting portion, respectively; retaining a low-melting member by the retaining means, which low-melting member is lower in melting point than the electrically-conductive metal; and subsequently heating the low-melting member to once melt the same to gather the molten low-melting member around the retaining means, and subsequently cooling the molten low-melting member to solidify the same, thereby forming a pair of cross-sectional area-increased portions adjacent to the opposites ends of the melting portion, respectively.

The retaining means can comprise caulking projections extending respectively from the opposite ends of the melting portion.

With the above construction, the cross-sectional area-increased portions are formed adjacent to the opposite ends of the melting portion, respectively, so that the constriction rate of the melting portion is increased, and therefore because of a heat-collecting effect due to this constricted portion, the position of the melting portion can be specified easily, and also the space of the heating portion can be narrowed easily. Moreover, the cross-sectional area-increased portions are formed by heating the low-melting member to once melt the same and then by solidifying it, and therefore the constricted portion can be easily formed, thereby expanding the degree of freedom of the design with respect to the constricted portion.

Furthermore, the cross-sectional area-increased portions, formed respectively adjacent to the opposite ends of the melting portion, are composed of the low-melting material, and therefore when the melting portion generates heat, the low-melting material flows into the melting portion, so that this low-melting material can absorb the heat of the melting portion by a heat-absorbing effect, that is, through heat transfer, thereby ensuring the slowly-breaking property of the melting portion.

BRIEF DESCRIPTION OF THE DRAWINGS

FIG. 5(*b*) is a cross-sectional view of an important portion of the above conventional fuse;

FIG. 6(*b*) is a cross-sectional view of an important portion of the above fuse.

DETAILED DESCRIPTION OF THE PREFERRED EMBODIMENTS

A preferred embodiment of the present invention will now be described in detail with reference to the accompanying drawings.

First, a method of producing a slowly-breaking fuse of the invention will be described with reference to FIGS. 1 to 3.

Figure 1:
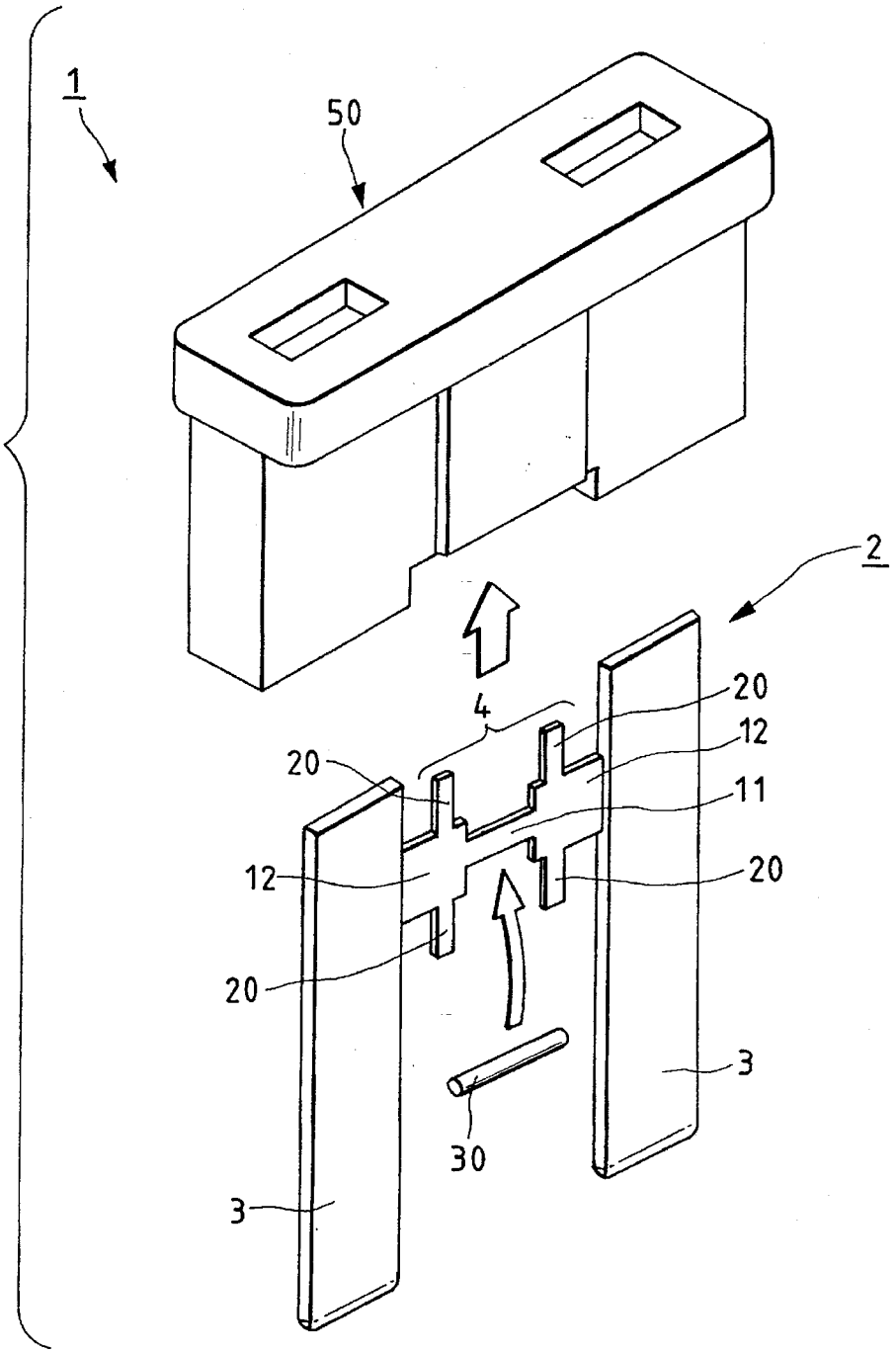
FIG. 1 is an exploded perspective view of one preferred embodiment of a slowly-breaking fuse before processing.

As shown in FIG. 1, the slowly-breaking fuse 1 comprises a housing 50 of a synthetic resin, and a fuse element 2 which is a fusible member of high-melting, electrically-conductive metal such as a copper alloy. The fuse element 2 is inserted into the housing 50 to provide an integrally-connected construction.

The fuse element 2 includes a pair of terminal portions 3 and 3 for electrical connection, and a melting portion 4 extending between these terminal portions 3 and 3. The fuse element 2 is formed into a unitary construction, and is made of relatively high-melting, electrically-conductive metal such as copper. The melting portion 4 is smaller in thickness than the terminal portions 3 and 3, and has a narrow elongate central portion 11 (serving as a hot spot) formed between base portions 12 and 12. A pair of caulking projections 20 and 20 serving as retaining means extending respectively from opposite edges of each of the base portions 12 and 12 disposed respectively at the opposite ends of the narrow elongate portion 11.

A low-melting piece 30 comprises a wire made of a low-melting material, such as tin, which is lower in melting point than the fuse element 2.

Figure 2:
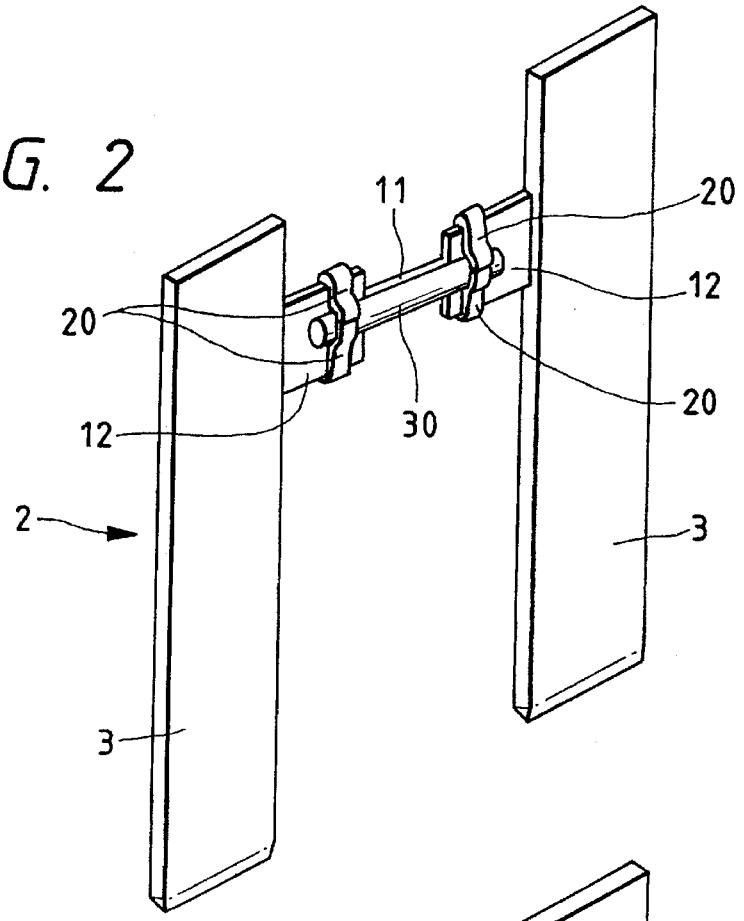
FIG. 2 is a perspective view of a fuse element of FIG. 1 during the processing.
Figure 3:
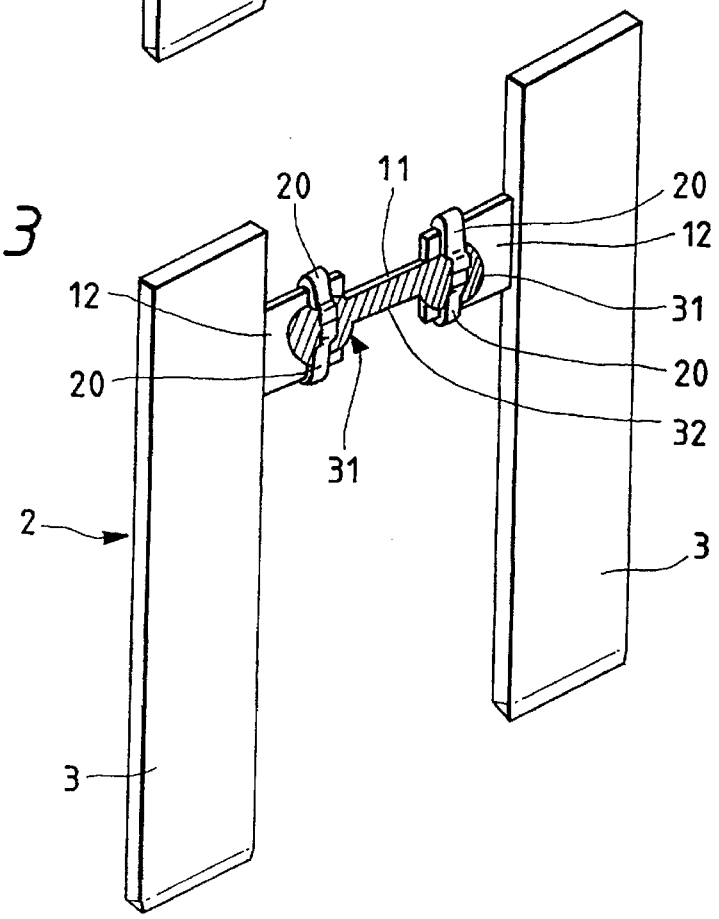
FIG. 3 is a perspective view of the fuse element of FIG. 2 after the processing.
Figure 4:
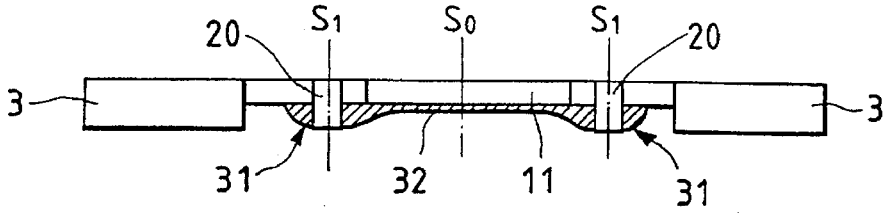
FIG. 4 is a top plan view of the fuse element of FIG. 3.
Figure 5A:
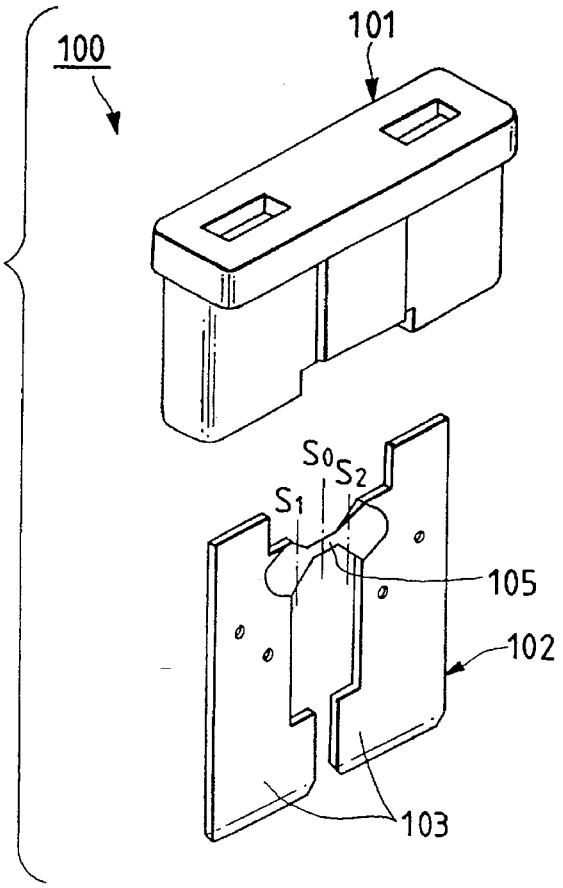
FIG. 5(a) PRIOR ART
FIG. 5(*a*) is an exploded perspective view of a conventional slowly-breaking fuse.
Figure 5B:
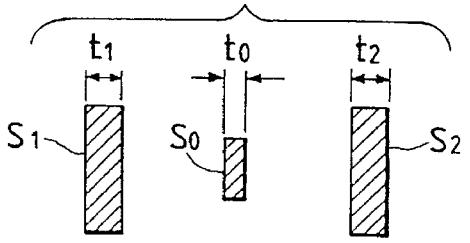
FIG. 5(b) PRIOR ART
Figure 6A:
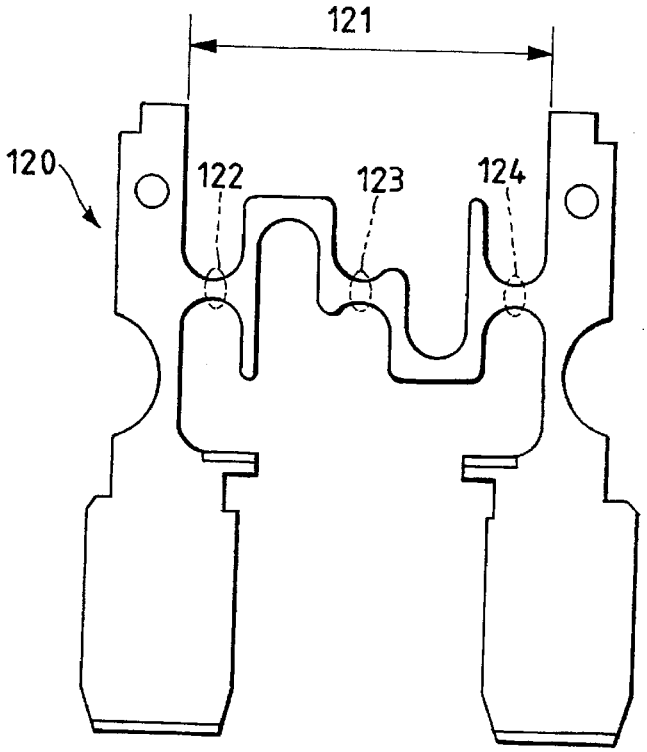
FIG. 6(a) PRIOR ART
FIG. 6(*a*) is another conventional slowly-breaking fuse.
Figure 6B:
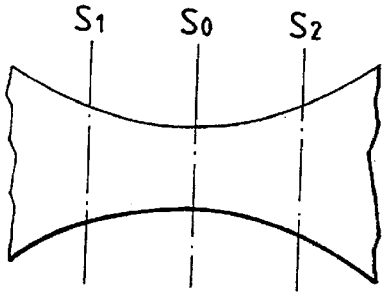
FIG. 6(b) PRIOR ART
Figure 7:
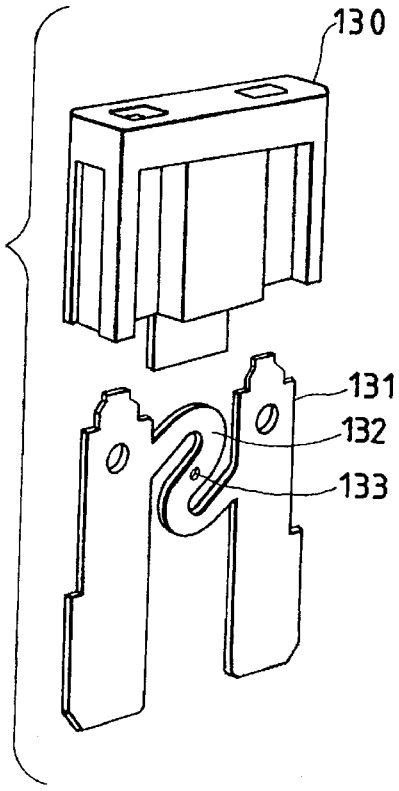
FIG. 7 PRIOR ART
FIG. 7 is an exploded perspective view of a further conventional slowly-breaking fuse.

As shown in FIG. 2, the low-melting piece 30 is held in contact with the narrow elongate portion 11 and the two base portions 12 and 12, and each pair of upper and lower caulking projections 20 and 20 are bent to compressively clamp the low-melting piece 30 in a gripping manner.

Thereafter, a flux is coated onto the thus clamped low-melting piece 30, and this low-melting piece 30 is beforehand melted by laser beam radiation, a reflow furnace or the like. As a result, because of a surface tension, the melted low-melting piece 30 tends to gather or agglomerate around the caulking projections 20 and 20. This phenomenon is the same as a phenomenon in which when soldering terminals to a printed circuit board, the molten solder gather on the terminals because of a surface tension.

As a result, most of the molten low-melting piece 30 on the narrow elongate portion 11 gathers around the caulking projections 20, so that only a small amount of the molten piece remains on the narrow elongate portion 11.

In this condition, the heating is stopped, so that the molten low-melting piece 30 solidifies around the caulking projections 20 to form agglomerate portions (cross-sectional area-increased portions) 31, an also the solidified material forms a thin film portion 32 on the narrow elongate portion 11. Here, in the melting portion 4, the agglomerate portions 31 are particularly bulged whereas the thin film portion 32 is thin, thus assuming a twin mountain-like configuration.

Therefore, the cross-sectional area $S_0$ of the narrow elongate portion (the hot spot) 11 at a position corresponding to a generally central portion of the thin film portion 32 is smaller than the cross-sectional area $S_1$ and $S_1$ of the agglomerate portions 31 and 31, thereby obtaining a sufficiently large constriction rate.

Thus, in the slowly-breaking fuse 1 produced by the production method of the present invention, the cross-sectional area-increased portions are formed respectively at the opposite ends of the narrow elongate portion (the hot spot) 11, so that the constriction rate of the melting portion 4 is increased. Therefore, because of a heat-collecting effect due to this constriction, the position of the melting portion can be easily specified, and also the space of the heating portion can be easily narrowed. With this arrangement, the transfer of the heat to the vicinity parts including the housing 50 and the terminal portions 3 can be reduced, and the overall heating of the fuse element 2 can be suppressed, and besides the heating of the fuse element 2 is effectively used, thereby achieving the slowly-breaking fuse excellent in fusion sensitivity even in a low current region.

The agglomerate portions 31 and 31 are formed by once melting the low-melting piece 30 by heating and then by solidifying it, and therefore the constricted portion can be formed more easily than by machining, and the degree of freedom of the design with respect to the constriction rate is expanded.

In the above slowly-breaking fuse, the agglomerate portions 31 and 31, formed respectively at the opposite ends of the narrow elongate portion 11, are composed of a low-melting material such as tin, and therefore when the narrow elongate portion 11 generates heat, the low-melting material constituting the agglomerate portions 31 and 31 flows into the hot spot, so that this low-melting material can absorb the heat of the melting portion by a heat-absorbing effect, that is, through heat transfer. As a result, the time required for the fusion of the melting portion 4 is prolonged, thereby ensuring good slowly-breaking properties.

Although the retaining means for provisionally retaining the low-melting piece 30 is preferably integrally formed with the melting portion as is the case with the caulking projections 20 of the above embodiment, the retaining means may be separate from the melting portion, in which case the retaining means is engaged with the melting portion 4 by physical means (e.g. winding) or chemical means (provisional engagement by spot welding or an adhesive).

In the above embodiment, although copper is used as the electrically-conductive metal constituting the fusible member, the invention is not limited to this, and for example, a copper alloy (having a melting point of 1,050° C.), a zinc alloy, a lead alloy, an aluminum alloy or others can be used. As the low-melting material having a melting point lower than that of the above electrically-conductive metal, tin (having a melting point of 230° C. as in the above embodiment) and other low-melting point, such as a tin alloy, bismuth, a bismuth alloy and antimony.

In the slowly-breaking fuse of the invention, as well as the method of producing the same, the fusible member having the sufficiently large constriction rate can be produced at low costs, and besides the constricted portion can be formed more easily than by machining, and the degree of freedom of the design with respect to the constriction rate can be expanded.

The melting portion has the sufficient constriction rate, and because of the heat-collecting effect due to this constricted construction, the position of the melting portion can be easily specified, and also the space of the heating portion can be easily narrowed, and besides the hot space is reduced as much as possible so that the fusible member can be fused at an extremely narrow region.

With this construction, the transfer of the heat to the vicinity portions including the housing and the terminal portions can be reduced, thereby suppressing the overall heating of the fusible member, and the heating of the fusible member is effectively used, thereby achieving the slowly-breaking fuse excellent in fusion sensitivity even in a low current region.

The cross-sectional area-increased portions, formed respectively adjacent to the opposite ends of the melting portion, are composed of a low-melting material, and therefore when the melting portion generates heat, the low-melting material flows into the melting portion, so that this low-melting material can absorb the heat of the melting portion by a heat-absorbing effect, that is, through heat transfer. As a result, the time required for the fusion of the melting portion is prolonged, thereby ensuring good slowly-breaking properties.

Therefore, there can be provided the good slowly-breaking fuse, as well as the method of producing the same, in which the constriction rate of the melting portion of the fusible member is increased, and the position of the melting portion can be specified, and also the space of the heating portion can be narrowed, and there are provided highly-sensitive fusion characteristics which enable the fusion with a limited amount of the generated heat.

What is claimed is:

1. A slowly-breaking fuse comprising:

a housing made of synthetic resin;

a fuse element including:

a pair of terminal members for an electrical connection; and a melting member mounted between the terminal members, the melting member being smaller in thickness than the terminal member, the melting member having a narrow elongated central portion and a pair of base portions between which the narrow elongated central portion is mounted; and a cross-sectional area increased member provided on said base portions of the melting member so that the cross-sectional area of said base portions is greater than the cross-sectional area of said central portion.

2. A slowly-breaking fuse as claimed in claim 1, further comprising:

retaining means for retaining a low melting member, the retaining means arranged at the base member, wherein the cross sectional area increased member includes the low-melting member which has been molten.

3. A slowly breaking fuse as claimed in claim 1, wherein the low-melting member is lower in temperature than an electrically-conductive material of which the fuse element is made.

4. A slowly breaking fuse as claimed in claim 2, wherein the low-melting member is solidified at the retaining means.

5. A slowly breaking fuse as claimed in claim 2, wherein the retaining means includes press-fitting projections extending from the opposite ends of the melting member.

* * * * *